United States Patent [19]

Annerhed et al.

[11] 4,007,351

[45] Feb. 8, 1977

[54] SYSTEM FOR INSTALLING HIGH STRENGTH STEEL BELTS

[75] Inventors: Karl Bertil Verner Annerhed; Rolf Ingemar Hemlin, both of Sandviken, Sweden

[73] Assignee: Sandco Ltd., Ottawa, Canada

[22] Filed: Sept. 24, 1974

[21] Appl. No.: 508,752

[52] U.S. Cl. ..... 219/50; 148/142; 219/137 R

[51] Int. Cl.[2] ..... C21D 1/18; B23K 9/00

[58] Field of Search ..... 148/127, 142; 219/50, 219/137

[56] References Cited

UNITED STATES PATENTS

| | | | |
|---|---|---|---|
| 2,809,265 | 10/1957 | Jackson | 219/50 X |
| 3,272,968 | 9/1966 | Volker | 219/137 X |
| 3,275,794 | 9/1966 | Dubusker et al. | 219/137 |
| 3,365,343 | 1/1968 | Vordahl | 148/142 X |
| 3,660,176 | 5/1972 | Denhard, Jr. | 148/142 |

*Primary Examiner*—Bruce A. Reynolds
*Assistant Examiner*—N. D. Herkamp
*Attorney, Agent, or Firm*—Harold L. Stults

[57] ABSTRACT

A method and apparatus for installing endless steel belts or steel bands of improved characteristics on machines of the type having a large roll and an endless steel belt extending around the roll and held under tension against the roll surface as the roll is turned. This type of equipment is used for producing a continuous sheet of a product by feeding a layer of the feed products in between the belt and the roll to thereby compress the products while subjecting them to a heat treatment. The belts must be replaced from time to time and must be repaired upon occasion, and the present invention permits such replacement and repair with belts having very high tensile strength.

10 Claims, 6 Drawing Figures

Fig. 1
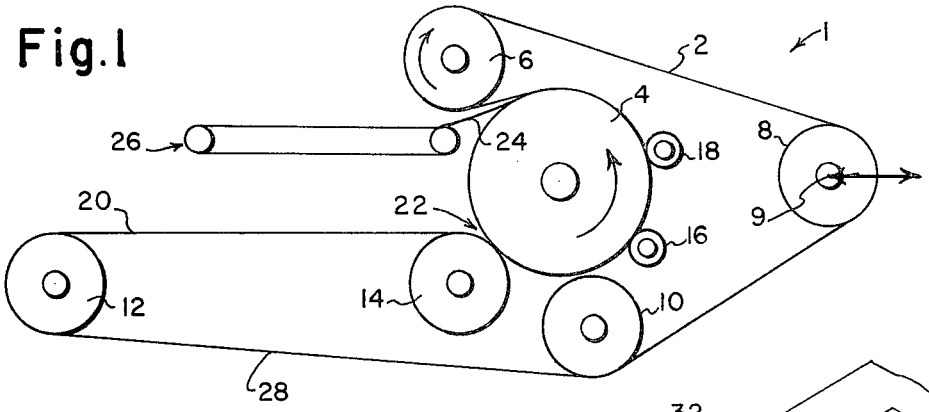
Fig. 2
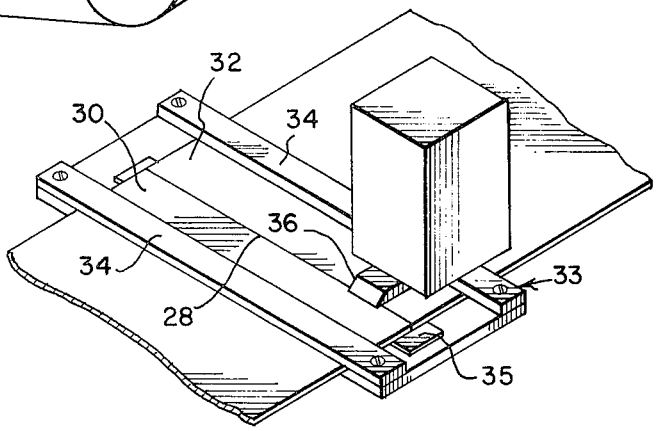
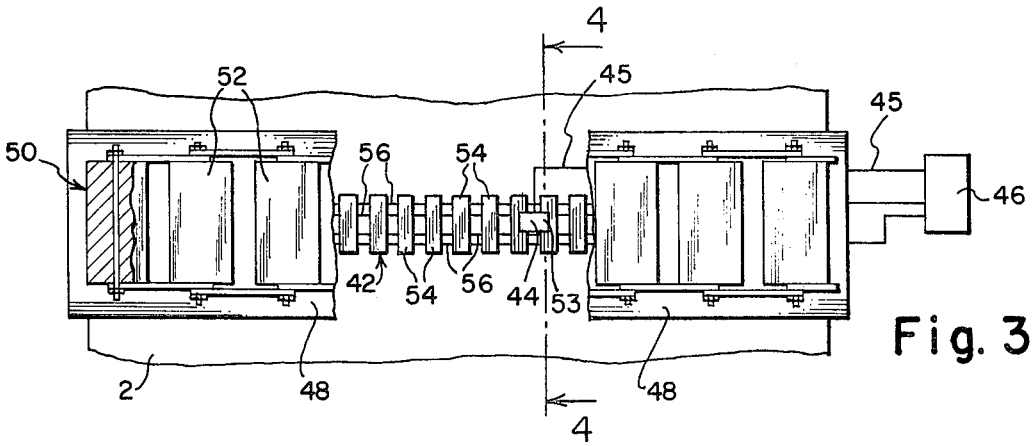
Fig. 3
Fig. 4
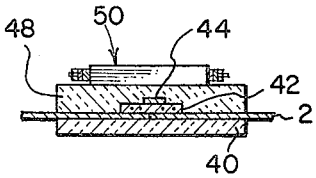

SYSTEM FOR INSTALLING HIGH STRENGTH STEEL BELTS

This invention relates to the installation and repair of superior types of belts upon machines requiring high tensile strength characteristics of the belt. Particularly, the invention relates to the installation and repair of belts in machines for producing sheet products under elevated pressures and temperatures.

Certain products are produced in continuous sheet form upon machines having an internally heated roll around which an endless steel belt extends, with the belt being held tightly against the roll surface. The roll is turned by the belt and the feed products are fed into the nip where the belt passes toward the roll surface. The tension on the belt is such that the feed products are compressed under the desired pressure as the roll and belt move together, and heat from the roll produces the proper curing of the feed products. The continuous sheet is discharged at the zone where the belt moves away from the drum. The rate at which the sheet is produced depends upon the speed at which the belt moves with the roll surface as the roll is rotated, and that is limited by the fact that the feed products must be held under the required pressure in contact with the roll for a period of time sufficient to produce the desired curing of the feed products. From the standpoint of providing a high production rate, it is desirable for the belt to be held against the feed products on the roll through the maximum arc consistent with providing for the introduction of the feed products and the removal of the product. The two runs of the belt extending to and from the roll are held under the tension necessary to produce the desired pressure exerted by the belt against the layer of feed products. It is thus seen that the design of the machine must take into account the tensile strength of the belt, and the rate of production must be limited for any particular machine design by that tensile strength characteristic.

During operation the belt is subjected to three major stresses. There is the predetermined tension throughout the belt to produce the desired pressure on the food products against the roll. There is the additional tension on the belt run extending from the drum representing the tension necessary to drive the rolls around which the belt extends. The other stresses are the bending stresses resulting from the belt conforming to the contours of the rolls around which the belt passes. The bending stresses are increased with increases in the belt thickness, but the belt must be thick enough to have dimensional rigidity. That is, it must not be easily deformed by impacts or by large particles in the feed products being compressed. The maximum total stress conditions exist within the zone where the belt is being pulled onto the drive roll.

These belts become fatigued during use by the flexing and tension stresses, so that they must be replaced from time to time, and they may become damaged or flaws may appear which require repairing. Belts of this type are made by welding together the ends of a sheet of the proper length. Ideally, the weld joint should have the exact characteristics of the remaining portion of the belt, because variations along the belt in the various characteristics of the metal in the belt may cause excessive stresses at specific zones. Furthermore, if the belt requires repair, for example, because of the formation of a crack at one edge, it is very important to remove and replace the portion of the belt around the crack with a portion of identical steel, and that weld joint should have the same characteristics as the remainder of the belt.

Machines of the type under consideration are large and heavy and it is always desirable and often necessary to install the belt by threading the belt band along its path in the machine and then producing an end-to-end butt weld joint. For that reason, the belts must be of steels which can be welded while in place on such machines. In the past the steel belts which could be welded in that manner have not been fully satisfactory, for example, because of low strength in the vicinity of the weld joint.

As pointed out above, the strength of the steel in the belt limits the production rates of the machines discussed. It is also important that the belt have endurance strength, i.e. a long lifetime. It is an object of the present invention to provide belts in machines of the type discussed above which are superior to those which have been available in the past. It is a further object to provide such belts which will give greater freedom of design for such machines. Another object is to provide improved apparatus and methods for producing and installing endless steel belts of the type discussed above. These and other objects will be in part, obvious and in part, pointed out below. Referring to the drawings:

FIG. 1 is a schematic representation of a machine which includes a belt which has been produced and installed in accordance with the present invention;

FIG. 2 is a somewhat schematic view showing the manner of producing the weld joint in the belt of FIG. 1;

FIG. 3 is a somewhat schematic view of the equipment for aging the weld joint in the belt of FIGS. 1 and 2;

FIG. 4 is a sectional view on the line 4—4 of FIG. 3;

Figure 5:
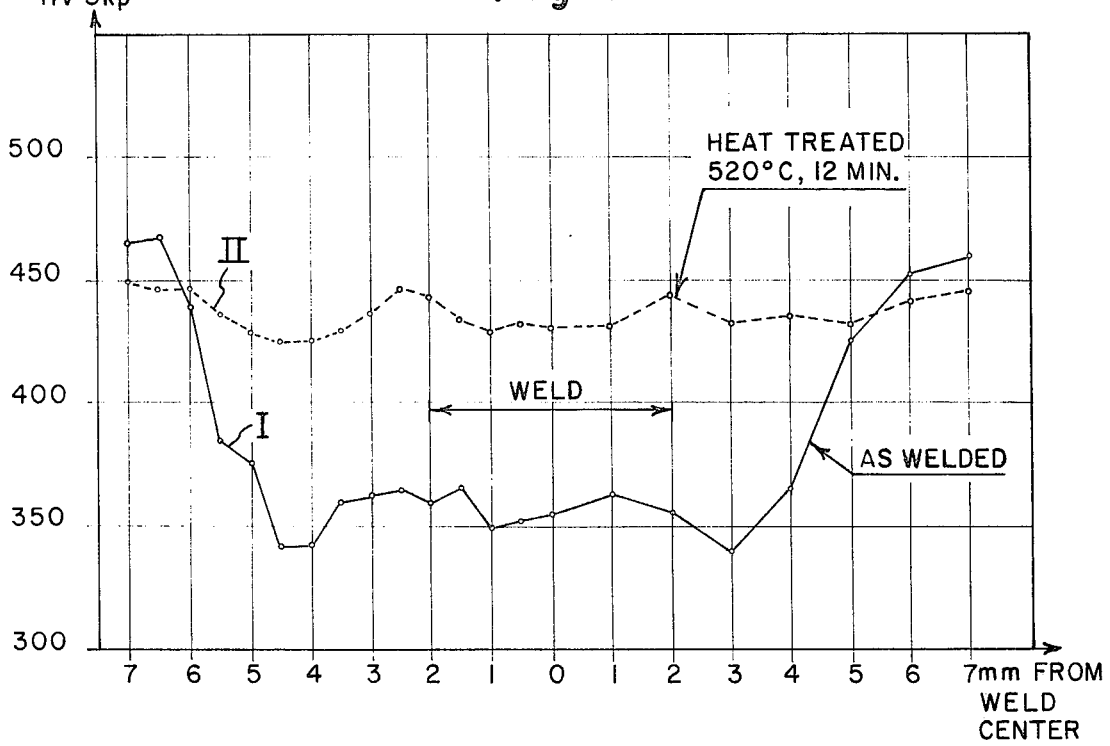
FIG. 5 shows the hardness of a weld joint in a belt of 15-5 PH stainless steel, before and after aging; and, FIG. 6 shows the hardness of a weld joint in a belt of maraging steel before and after aging.

The present invention contemplates producing high strength endless steel belts positioned for use from steel bands of steel which have the characteristic of being precipitation hardenable by aging so as to increase their tensile and yield strengths. The specific steels which are presently contemplated are 17—4 PH and 15—5 PH, which are chromium stainless steels having a high content of copper, and maraging steels which are high nickel steels containing a high content of cobalt and substantially no carbon. Belts of those steels can be welded in the field, and the precipitation hardening of the weld joint is produced by heat treating the weld joint at a predetermined temperature for a predetermined period of time. That is, the original belt or steel band is of the desired length and thickness and is fabricated and aged prior to shipment to the site of installation, and then the belt is installed and the ends are welded together. The weld joint is then aged so as to have substantially the same tensile and yield strengths as in the remainder of the belt. There is a close correlation between the tensile strength of these steels and the specific hardness. Accordingly, after the aging and finishing of the weld joint in the field, a hardness test is carried on across the weld joint and the adjacent portion of the belt to insure that the hardness does not deviate materially from the uniform hardness of the main portion of the belt. That test insures that the tensile strength at the weld joint is within the acceptable range required for the steel belt.

In the illustrative embodiment, the welding equipment makes possible uniform temperature and welding conditions along the entire length of the weld joint. In preparing the belt ends for welding they are scribed and cut and the edges are deburred to provide a fit between the abutting ends with a maximum gap of 0.1 mm. The belt ends are then clamped in a jig and stop plates are positioned along the path of movement of the welding unit to act as stops at the beginning and end of the welding operation. A gas shield is provided in the welding zone. The following are illustrative operating conditions for the respective belt thicknesses of 1.0 mm and 1.8 mm of 15-5 PH stainless steel: welding current —55 and 100 amperes; arc voltage —9.5 and 10.5 volts; welding speed —22 and 18 centimeters per minute; wire feed —65 and 60 centimeters per minute; and shield gas —8 and 8 liters per minute.

Referring to FIG. 1 of the drawings, a press 1 has a steel belt 2 which is mounted to pass around a heated drum roll 4 and thence around auxiliary rolls 6, 8, 10, 12 and 14 in that order. Roll 6 is a drive roll which draws the belt from roll 4, so that all of the rolls are driven by the belt. A pair of nip rolls 16 and 18 press the belt against roll 4. Roll 8 acts as a tension roll, and its axis 9 is mounted to be adjustably moved as indicated to the right and left, respectively, to increase and decrease the tension on the belt. During operation, the feed material or product is fed onto the horizontal belt run 20 and is spread to provide a uniform layer which passes the nip 22 at roll 14 between the belt and roll 4. As the layer of the product passes around roll 4, it is held under a substantial predetermined pressure by the tension on the belt and the product is cured into the final product by the heat from roll 4. Nip rolls 16 and 18 provide added pressure and smooth out any irregularities in the product layer. The product is discharged in a continuous sheet 24 and passes onto a discharge conveyor 26.

The endless belt 2 is a replacement belt which has been installed by threading a steel belt of the length and width of the finished belt around the rolls along the belt path with its ends intermediate rolls 10 and 12, and then welding the ends together by a weld joint 28. Referring to FIG. 2, in producing weld joint 28, the belt ends 30 and 32 are positioned in end-to-end relationship in a jig 33, and are clamped in place by the transverse clamps 34. A copper backup plate 35 is positioned beneath ends 30 and 32, and the weld joint is produced by the weld head 36 to which welding wire is fed. The weld joint is then finished so as to have the same thickness and surface characteristics as the adjacent belt portions.

The weld joint is then aged by subjecting it to a selected heat treatment at a predetermined temperature for a predetermined period of time.

Referring to FIGS. 3 and 4 the belt is placed upon a flat plate which is covered by a heat insulation blanket 40. An electric heating mat 42 is then placed on top of the weld joint and a sensor 44 is positioned on top of the heating mat. Sensor 44 is formed by a rectangular sheet metal plate and supports a thermocouple which is connected by wires 45 to a thermostatic control unit 46. Control unit 46 includes a timer, and controls the duration and temperature of the aging process. A heat-insulation blanket 48 is then placed on top of the heating mat and sensor 44, and an articulated weight unit 50 is then placed on top of the blanket over the entire area of the weld joint. Weight unit 50 is a series of rectangular blocks 52 which are hinged one to another along axes parallel to their longitudinal axes. Hence, each block 52 lies transversely of the weld joint, and the hinged relationship permits each block to rest evenly on the blanket so as to provide an evenly distributed weight.

Heating mat 42 is formed by a number of rectangular metal blocks 54 and a flexible electric resistance heating wire 56. Each of the blocks has smooth, flat top and bottom surfaces, and has four horizontal bores through which the heating wire is threaded, with four runs of the wire extending the length of the mat and forming a continuous electrical resistance heating circuit. The heating wire fits snugly in the bores through blocks 54 so as to provide a good heat transfer relationship from the heating wire to each of the blocks.

Plate 53 of sensor 44 has substantially the same heat receiving and dissipating characteristics as a similar rectangular portion of the weld joint. Also, the contact between plate 53 and the metal blocks is through surfaces identical with the bottom surfaces of the block, and the sensor is insulated by blanket 48 in the same way in which the weld joint is insulated below by blanket 40. The flexibility of wire 56 permits weight unit 50 to press each of blocks 54 firmly against the top surface of the weld joint, and sensor 44 is pressed similarly against the blocks upon which it rests. Hence, heat passes from wire 56 through blocks 54 to the weld joint and also to the sensor. The substantially identical heat receiving and dissipating characteristics of the sensor plate and the weld joint and the arrangement for subjecting them to the same pressure by weight unit 50, insures that they are subjected to the same heating and heat-dissipating conditions, and that insures that the sensor plate will always have substantially the identical temperature as the weld joint. During operation, control unit 46 acts in response to the sensor to supply electrical current to heating wire 56, and thereby maintains accurate control upon the weld joint temperature.

For aging the weld joint, the components are assembled as shown, and the temperature control unit 46 then turns on the electric current. When the weld joint has been heated to the predetermined aging temperature, the timing period starts, and the control unit maintains the weld joint at that temperature for the set period of time. The electric current is then turned off and the weld joint is permitted to cool before blankets 48 and 49 are removed. If desirable, the weld is then tested for tensile strength by a hardness test. Belt 2 is then tightened by adjusting roll 8, as explained above.

Figure 6:
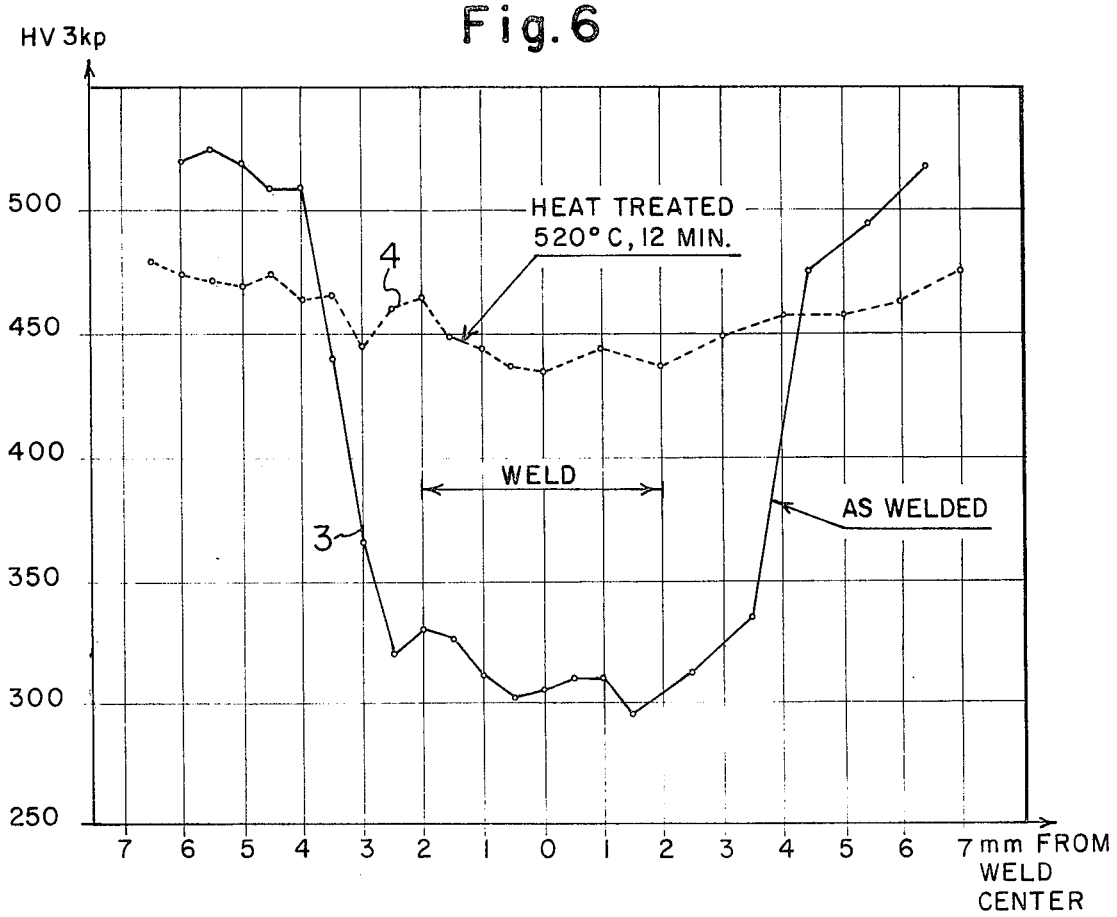

As indicated above, belt 2 is of 15-5 PH stainless steel, but the invention contemplates the use of other precipitation hardenable steels including maraging steels. Also, it has been indicated above that with these steels there is a true relationship between the yield and tensile strengths and the hardness of these steels. Hence, as a practical matter, for purposes of determining if those strengths of the weld joints are within acceptable limits, the hardness is tested. FIG. 5 shows the hardness along a line through weld joint 28 and parallel to the edge of the belt, Curve I being before the aging and Curve II being after the aging. Referring to Curve I, the hardness and therefore those strengths, are relatively low except at the edges of the weld joint. However, Curve II shows that the strengths of the main portion of the weld joint have been increased materially to within the range of acceptable tolerance. FIG. 6 has curves 3 and 4 which correspond respectively to FIGS. I and II, but relate to a weld joint of eighteen (18%) percent maraging steel containing a relatively high content of cobalt and substantially no carbon. It is noted that the aging brings the hardness within the range of the remainder of the belt, and that confirms that acceptable values of yield strength and tensile strength have been attained.

It should be noted that the steel belt from which the endless belt is made has been subjected to the same aging process as that which is performed on the weld joint. When the weld joint is being processed for aging, the previously aged portions of the belt adjacent the weld joint may be heated to a temperature sufficient to produce some further aging. That may age those belt portions slightly beyond the amount of maximum tensile strength so that the strength is slightly less than at the weld joint and throughout the remainder of the belt. However, that reduction is relatively insignificant and is generally within the normally expected variations in the strength characteristics of the belt.

Some machines similar to that of the illustrative embodiment are provided with two belts which move together through the processing zone with the feed products held captive between them. That is, one belt rides directly upon the heated drum roll, and the other belt holds a product against the first-mentioned belt. There are also other types of machines which operate in different manners, but which have belts of the type of the illustrative embodiment. It is contemplated that the present invention can be used with all such machines. It is understood that modifications and variations may be made in practicing the invention within the scope of the claims.

What is claimed is:

1. The method of installing an endless steel belt upon a machine for producing a product where the product is held under pressure by the belt under tension, the steps of, installing a belt and band long the path of the belt in the machine wherein the belt band is of a steel which has been precipitation hardened to a predetermined high tensile strength, positioning the ends of the belt band in substantially end-to-end abutting relationship, clamping the belt portions adjacent said ends in said relationship, welding said ends together using welding wire of steel having the same characteristics as those of the belt band to form a weld joint, heat-insulating said weld joint without removing the belt band from the machine, heating said weld joint with electric heating means to a temperature which will produce precipitation hardening of said weld joint, and controlling said heating and terminating it at the end of the period required to increase the yield strength and tensile strength of said weld to substantially the strength of the belt band.

2. The method of installing an endless steel belt which comprises, the steps of, aging a belt band of steel having the characteristic that its tensile strength increases to a maximum value when aged for a predetermined period of time and at an elevated temperature, positioning the belt band in a machine along its path of movement during use with its ends being positioned in coextensive end-to-end adjacent relationship, clamping said ends in said relationship, producing a weld joint by welding said ends together with steel wire having the same formulation as the steel in said belt strip, heat-insulating said weld joint without removing the belt band from the machine, heating said weld joint by electric heating means positioned upon said weld joint, exerting a constant pressure on said heating means to insure a uniform heat transfer relationship between said heating means and said weld joint, supplying electric current to said heating means, sensing the temperature produced by said heating means at said weld joint, controlling the supplying of electric current to said heating means in accordance with the temperature sensed, and thereby maintaining said weld joint at a temperature which will produced precipitation hardening of the weld joint, and controlling the time period of heating to produce precipitation hardening of the weld joint such as to increase the yield strength and tensile strength of the weld joint to substantially the strength of the belt band.

3. The method as described in claim 2 which includes the initial step of positioning said belt strip ends with their side faces substantially horizontal, thereafter positioning electric heating means along the top surface of said weld, said heating means including a resistance heater and heat distributing means having a heat transer surface which contacts said weld so as to transfer heat thereto at a temperature less than the temperature of said resistance heating means.

4. In a method for installing a steel belt of high tensile strength, the steps of, producing a steel belt band of steel which is precipitation hardenable, precipitation hardening said belt band to substantially its maximum tensile strength and yield strength, positioning said belt band along its path of movement during use with its ends positioned in coextensive end-to-end adjacent relationship, welding said ends of said belt band together to form a weld joint with its side faces generally parallel with those of the belt band, heating said weld joint with electric heating means and metal block means in heat exchange relationship therewith without removing the belt band from the machine, said metal block means having heat-transfer surfaces which contact one surface of said weld joint and transfer heat thereto at a temperature which is less than the temperatute of said electric heating means, heat-insulating both sides of said weld joint and said heating means, supplying electric current for said heating means, and controlling said electric current to produce heat at a rate to heat said weld joint to a predetermined temperature at which said weld joint is precipitation hardened and maintaining said weld joint at said predetermined temperature for the predetermined period of time required to precipitation harden said weld joint to substantially the tensile strength of the belt band, said heating means and said insulating means cooperating to subject said weld joint in its entirety to uniform heating and to maintain said predetermined temperature throughout said weld joint for said predetermined period of time.

5. The method as described in claim 4 wherein said step of controlling the electric current includes the step of sensing the temperature of an element positioned on said block means and being so constructed and arranged as to have the same effective temperature as said weld joint.

6. The method as described in claim 4 wherein said belt band and said weld joint are of maraging steel which is substantially carbon free and of relatively high nickel content.

7. The method as described in claim 4 wherein said belt band and said weld joint are of stainless steel containing the following constituents in percentages which are substantially of the order of: chromium 14 to 15½%, nickel 3.5 to 5.5%.

8. In a method of the character described in which it is desirable to weld together the mating edges of belt portions wherein the belt is of substantially uniform high tensile strength and said belt portions have been precipitation hardened, the steps of, positioning said edges adjacent each other for welding, clamping said belt portions in their respective positions, producing a weld joint interconnecting said edges by utilizing welding steel having the same characteristics as the steel from which said belt portions were formed, heat insulating said weld joint and the adjacent belt portions without removing the belt from the machine, heating said weld joint in a uniform manner, controlling said heating to maintain said weld joint at a substantially predetermined temperature, and controlling the period of heating in accordance with the characteristics of the steel from which the weld joint has been formed to produced precipitation hardening of the weld joint to a hardened condition which is within an acceptable range of the hardened condition of said belt portions, whereby the weld joint and said belt portions have essential characteristics which are within acceptable ranges.

9. The method as described in claim 8 which includes, controlling said heating by sensing the temperature of an element having substantially the heat absorption characteristics of said weld joint and which is positioned to receive heat at substantially the same rate at which said weld joint receives heat and which is positioned to be subjected to said heat insulating so that it dissipates heat at substantially the same rate as said weld joint 10. The method of installing an endless steel belt on a machine for producing a product wherein the product is held under pressure by the belt under tension, said method comprising the steps of, placing a belt band formed of a precipitation hardened steel having a predetermined high tensile strength along a predetermined path in the machine; positioning the ends of the belt band in aligned substantially end-to-end abutting relation, clamping and maintaining the belt portions adjacent the ends of the belt in said aligned substantially end-to-end abutting relationship, forming a weld joint; between the ends of said belt by welding the belt ends together using a steel welding wire having the same characteristics as those of the belt; placing a plurality of metal heating blocks on one side of the weld joint in heat exchange relationship therewith without removing the belt band from the machine, heat insulating both sides of said weld joint by covering said one side and said heating blocks with a layer of heat insulating material and covering the opposite side of the weld with another layer of heat insulating material; placing a series of individual weights on the layer of insulating material covering said one side of the weld and said heating blocks and exerting a constant pressure on said heating blocks to insure a uniform heat transfer relationship between said heating means and said weld joint; supplying electric current to said heating blocks to heat said weld joint to a predetermined temperature selected to precipitation harden the steel of said weld joint; sensing the temperature produced by said supply of electric current to the heating blocks at the weld joint; controlling the supplying of electric current of said heating blocks in response to the temperature sensed in said sensing step to maintain the temperature of said weld joint at said predetermined temperature to produce precipitation hardening of the weld joint; and continuing said steps of supplying electric current, sensing, and controlling the electric current for a predetermined period of time selected to cause precipitation hardening of the weld joint at said predetermined temperature to produce substantially the tensile strength of said belt band in said joint.

* * * * *

UNITED STATES PATENT OFFICE

CERTIFICATE OF CORRECTION

Patent No. 4,007,351 Dated February 8, 1977

Inventor(s) Karl Bertil Verner Annerhed; Rolf Ingemar Hemlin

It is certified that error appears in the above-identified patent and that said Letters Patent are hereby corrected as shown below:

Claim 1, line 41, delete "and"; same line, correct "long" to read ---along---.

Claim 10, line 29, change "of" (second occurrence) to read ---to---.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*